US009834419B2

(12) United States Patent
Wacinski et al.

(10) Patent No.: US 9,834,419 B2
(45) Date of Patent: Dec. 5, 2017

(54) LINEAR DRIVING DEVICE WITH LOAD DEPENDENT CLAMPING CAPABILITY

(71) Applicant: Plumettaz Holding SA, Bex (CH)

(72) Inventors: André Wacinski, Bex (CH); Gérard Plumettaz, Territet-Veytaut (CH)

(73) Assignee: PLUMETTAZ HOLDING SA, Bex (CH)

( * ) Notice: Subject to any disclaimer, the term of this patent is extended or adjusted under 35 U.S.C. 154(b) by 0 days.

(21) Appl. No.: 14/415,919

(22) PCT Filed: Jul. 24, 2013

(86) PCT No.: PCT/EP2013/065649

§ 371 (c)(1),
(2) Date: Jan. 20, 2015

(87) PCT Pub. No.: WO2014/016355

PCT Pub. Date: Jan. 30, 2014

(65) Prior Publication Data

US 2015/0183623 A1 Jul. 2, 2015

(30) Foreign Application Priority Data

Jul. 27, 2012 (CH) ..... 1173/12

(51) Int. Cl.
*B66D 3/00* (2006.01)

(52) U.S. Cl.
CPC ..... *B66D 3/003* (2013.01)

(58) Field of Classification Search
CPC ..... B66D 3/003
(Continued)

(56) References Cited

U.S. PATENT DOCUMENTS 2,792,104 A 5/1957 Biedess
3,118,635 A 6/1964 Landsem
(Continued)

FOREIGN PATENT DOCUMENTS

CH 429 584 1/1967
DE 29 42 110 4/1981
(Continued)

OTHER PUBLICATIONS

CH 01173/12 Swiss Search Report dated Sep. 14, 2012 (3 pages).
PCT/EP2013/065649 International Search Report dated Oct. 10, 2013 (3 pages including English translation).

*Primary Examiner* — Michael R Mansen
*Assistant Examiner* — Nathaniel L Adams
(74) *Attorney, Agent, or Firm* — Brinks Gilson & Lione; G. Peter Nichols

(57) ABSTRACT

A linear driving device with load dependent clamping capability with a reference driving element and a moveable driving element. The linear driving device being arranged for driving an elongated element located between the reference driving element and the moveable driving element at least one of which is powered to apply an axial force (Fa) and a clamping force (Fc) to the elongated element to drive it. The device includes at least one pivoting lever attached to the reference driving element by a first rotation axis and to the moveable driving element by a second rotation axis. When the elongated element is driven, the at least one pivoting lever is arranged so that the magnitude of the clamping force (Fc) depends on a predetermined angle (a) defined between a perpendicular direction to the axial force (Fa) and a reaction force passing through the first and second rotations axes.

9 Claims, 2 Drawing Sheets

(58) Field of Classification Search
USPC ..... 254/265
See application file for complete search history.

(56) References Cited

U.S. PATENT DOCUMENTS

| | | | | |
|---|---|---|---|---|
| 3,643,848 | A * | 2/1972 | Haller | C03B 33/06 226/186 |
| 3,761,003 | A | 9/1973 | Sieurin | |
| 5,072,637 | A | 12/1991 | Reichental et al. | |

FOREIGN PATENT DOCUMENTS

| | | |
|---|---|---|
| EP | 0 455 112 | 11/1991 |
| EP | 1 118 796 | 7/2001 |
| JP | H 0687370 | 12/1994 |
| JP | 2011188563 | 9/2011 |

* cited by examiner

LINEAR DRIVING DEVICE WITH LOAD DEPENDENT CLAMPING CAPABILITY

This application claims priority to International Application No. PCT/EP2013/065649 filed Jul.24, 2013 and to Swiss Patent Application No. 1173/12 filed Jul. 27, 2012; the entire contents of each are incorporated herein by reference.

BACKGROUND

The present invention relates to a linear driving device and more particularly to a linear driving device having an improved clamping arrangement.

The document EP 1 118 796 B1 describes a linear winch or traction device having two caterpillars. One of these caterpillars is sliding relatively to the other one along a linear translation direction inclined to the axis of the pulled cable, so that the pulling onto the cable tends to move the sliding caterpillar towards the other one, to create a clamping force onto the cable. However, the disclosed arrangement is sensitive to dust, thus leading to the need of an adequate protection of the moveable parts, especially the sliding portions, so that cost and complexity will increase. Internal friction between the sliding parts will also decrease the efficiency of the device to create a clamping force from the pulling force, so that the reliability of the apparatus is questionable. Moreover, such winch is not adequate to pull a large variety of cables in terms of robustness. The magnitude of the clamping force is determined by the friction ratio (between the cable and sliding caterpillar), and the pulling force, in relation with the inclined slider. In other words, if some cables are too weak to resist to this non variable clamping force, it will be impossible to drive them without damage. The last concern with this winch is that it is impossible to drive the cable in two opposite directions (i.e. push-pull operations) without removing the cable out of the winch, turning the latter by 180° and reinstalling the cable between the two caterpillars to drive the cable in the opposite direction. This set up is long and reduces the overall operating availability of the equipment if numeral push-pull changes are required.

SUMMARY

The present invention aims to solve these aforementioned drawbacks and is directed to propose first a winch arranged to drive an elongated element, with a low sensitivity to dust, and with the ability to adapt the magnitude of the clamping force onto the elongated element.

With this goal in mind, a first aspect of the invention is a linear driving device comprising:

a reference driving element and a moveable driving element, the linear driving device being arranged for driving an elongated element located between the reference driving element and the moveable driving element, at least one of the reference driving element and the moveable driving element being powered to apply an axial force to the elongated element to drive it, the moveable driving element being moveable relative to the reference driving element so that the axial force combined to a friction between the elongated element and the moveable driving element presses the moveable driving element towards the reference driving element to create on the elongated element a clamping force, characterized in that the linear driving device comprises at least one pivoting lever attached to the reference driving element by a first rotation axis and to the moveable driving element by a second rotation axis, and when the elongated element is driven, the at least one pivoting lever is arranged so that the magnitude of the clamping force depends on a predetermined angle defined between a perpendicular direction to the axial force and a reaction force between the reference driving element and the moveable driving element and passing through the first and second rotations axes.

The present invention provides a linear driving device with a moveable driving element attached to the reference driving element by a rotating lever through rotation axes. The sensitivity of rotation axes to dust is lower than sliders, and sealing these axes is easier than sealing a slider. It results that the friction within the rotation axes is low, so that the mechanical losses within the articulations will not prevent the system from creating an efficient clamping force. In addition, the linear driving device, with the pivoting lever arranged so that the magnitude of the clamping force depends on the angle between a line perpendicular to the axial force and the reaction force passing through the first and second rotation axes, makes possible to obtain several angles, as the latter is defined between the moveable lever and a fixed direction. It is thus possible with such arrangement to adapt the clamping force magnitude to the strength of the elongated element, to avoid any damage.

Advantageously, the second rotation axis is moveable along a circular trajectory in a trajectory plane, and when the elongated element is driven, the predetermined angle is defined within the trajectory plane, between a line passing through the first and second rotation axes and a direction perpendicular to the axial force.

Advantageously, the at least one pivoting lever comprises adjustment means arranged to adjust a distance between the first rotation axis and the second rotation axis, thereby adjusting the predetermined angle. The adjustment means make possible to adjust the distance between the first and second rotation axes, so that the inclination of the lever is adjustable. The angle and the clamping force are easily adjusted with this embodiment.

Advantageously, the first rotation axis and/or the second rotation axis is attached to the at least one pivoting lever through an eccentric case. Such eccentric cases provide an easy and fast set up of the distance between the first and second axe. Fine tuning is also possible with this embodiment.

Advantageously, the moveable driving element comprises a caterpillar powered to apply the axial force to the elongated element.

Advantageously, the reference driving element comprises a caterpillar powered to apply an additional axial force to the elongated element. The efficiency of the linear driving device is improved with the additional axial force.

Advantageously, the moveable driving element, the reference driving element and the at least one pivoting lever arranged in a first geometrical configuration apply a first axial force in a first direction of the elongated element, and wherein the moveable driving element, the reference driving element and the at least one pivoting lever arranged in a second geometrical configuration, apply a second axial force in a second direction of the elongated element, opposite to the first direction of the elongated element. This embodiment achieves a reversible functioning of the linear driving device to allow push-pull operations.

Advantageously, the predetermined angle from the perpendicular direction to the reaction force in the first geometrical configuration has a first absolute value and is oriented in a first angular direction, and wherein the predetermined angle from the perpendicular direction to the reaction force in the second geometrical configuration has the same first absolute value but is oriented in a second angular direction opposite to the first angular direction. The change of driving position is achieved by a rotation of the pivoting lever around the first rotation axis, from the first geometrical position to the second geometrical configuration, the pivoting lever rotating by an angle being twice the first absolute value.

Advantageously, the linear driving device comprises a supporting frame, and the at least one pivoting lever is connected to the supporting frame by a third rotation axis. This embodiment makes the moveable driving element and the reference driving element both moveable relative to the supporting frame along circular trajectories, so that a set up of the position of driving elements is possible, to match for example the position of the elongated element.

Advantageously, the linear driving device comprises a second pivoting lever:

- attached to the reference driving element by a fourth rotation axis and to the moveable driving element by a fifth rotation axis, and
- arranged so that a line passing through the first and second axes is parallel to a line passing through the fourth and fifth rotation axes.

Advantageously, the linear driving device comprises pushing means arranged to push the moveable driving element onto the elongated element. The pushing means create a residual clamping force to achieve the contact between the reference driving element, the elongated element and the driving element. An elastic element such as a spring may be used, or a cylinder or the weight of the moveable driving element may also be used to create this residual clamping force.

BRIEF DESCRIPTION OF THE DRAWINGS

Other characteristics and advantages of the present invention will appear more clearly from the following detailed description of particular non-limitative examples of the invention, illustrated by the appended drawings where.

DETAILED DESCRIPTION

Figure 1:
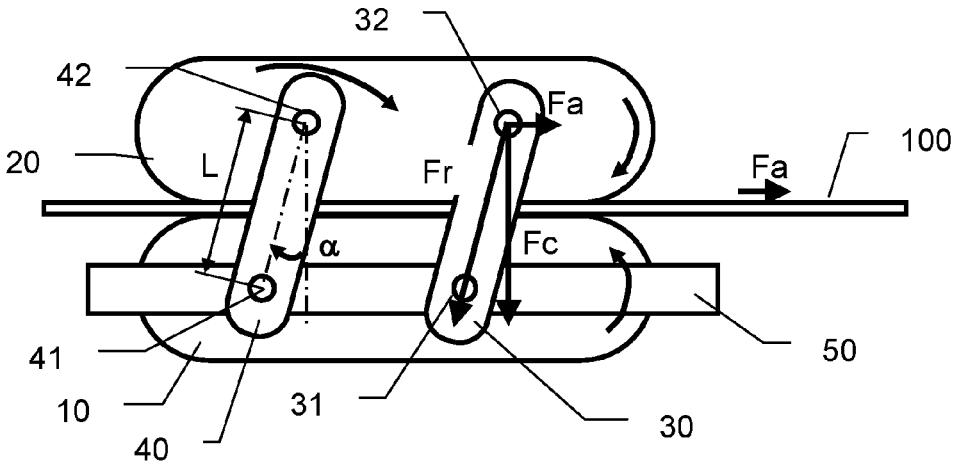
FIG. 1 represents a first embodiment of the invention.

The linear driving device represented at FIG. 1 comprises a reference driving element, a caterpillar 10 attached to a supporting frame 50, and a moveable driving element and a caterpillar 20. The two caterpillars 10 and 20 are arranged together to apply an axial force Fa to an elongated element 100 placed between themselves. The elongated element 100 may either be a cable, a tube, a duct or an optical fiber. The linear driving device may also drive any kind of elongated element 100 with a constant cross section (such as an ellipse or polygon), or with a variable cross section, with a constant period. The caterpillars 10 and 20 are attached together by a first pivoting lever 30 and a second pivoting lever 40. The first pivoting lever 30 is connected to the reference driving caterpillar 10 by a rotation axis 31, and to the moveable driving caterpillar 20 by a rotation axis 32. Similarly, the second pivoting lever 40 is connected to the reference driving caterpillar 10 by a rotation axis 41, and to the moveable driving caterpillar 20 by a rotation axis 42. The first and second pivoting levers are arranged so that the moveable driving caterpillar 20 has a circular trajectory within a first plane, and within this first plane, a first line passing through the rotation axes 31 and 32 is parallel to a second line passing through the rotation axes 41 and 42.

As shown at FIG. 1, the linear driving device is applying an axial force Fa to the elongated element 100. The moveable driving caterpillar 20 is powered by a motor (not shown) and rotates as represented by the arrow. The friction between the elongated element 100 and the moveable driving caterpillar 20 makes the moveable driving caterpillar 20 apply an axial force to the elongated element 100. This axial force, in relation to the friction and in relation to the trajectory imposed to the moveable driving caterpillar 20 by the first and second pivoting levers 30 and 40, presses the moveable driving caterpillar 20 towards the reference driving caterpillar 10, thus creating a clamping force Fc. In other words, the friction, combined to the axial force creates a downwards force Fc that presses the moveable driving caterpillar onto the elongated element. Since the moveable driving caterpillar 20 is connected to the reference driving caterpillar 10 by the pivoting levers 30 and 40, the reaction force Fr between the reference and moveable driving caterpillars 10 and 20 passes through the rotation axes 31-32 and 41-42, as shown. The clamping force Fc is then dependent on the angle $\alpha$, which is the inclination between the line connecting the rotation axes 31-32 or 41-42 and a direction perpendicular to the axial force Fa. The predetermined angle $\alpha$ is dependent from the length L between the two rotation axes 31-32 and 41-42, so that an adjustment of this length L will affect the predetermined angle $\alpha$ and as a consequence, the clamping force Fc. It is thus possible to set the length L to a value so that the clamping force will have a magnitude adapted either to the maximum stress the elongated element can withstand or to increase in return the maximum axial force applied to the elongated element to correctly drive it.

Figure 2:
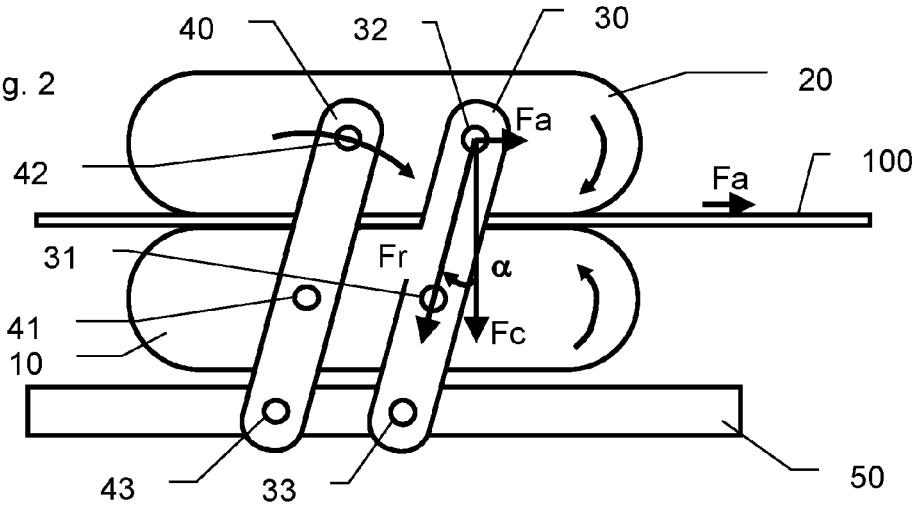
FIG. 2 represents a second embodiment of the invention.

FIG. 2 represents a second embodiment of the present invention. The reference driving caterpillar 10 and the moveable driving caterpillar 20 are both moveable relatively to the supporting frame 50 because the first pivoting lever 30 and the second pivoting lever 40 are both attached to the supporting frame 50. The first pivoting lever 30 is attached to the moveable driving caterpillar 20 by the rotation axis 32, and to the reference driving caterpillar 10 by the rotation axis 31. The second pivoting lever 40 is attached to the moveable driving caterpillar 20 by the rotation axis 42, and to the reference driving caterpillar 10 by the rotation axis 41. Similarly to the first embodiment, the moveable driving caterpillar 20 is powered by a motor (not shown) to apply to the elongated element 100 the axial force Fa, and is pressed towards the reference driving caterpillar 10 due to the friction between the elongated element 100 and the moveable driving caterpillar 20. The clamping force Fc depends on the predetermined angle $\alpha$ defined between the reaction force Fr passing through the rotation axes 31-32 or 41-42, and the direction perpendicular to the axial force Fa.

Figure 3:
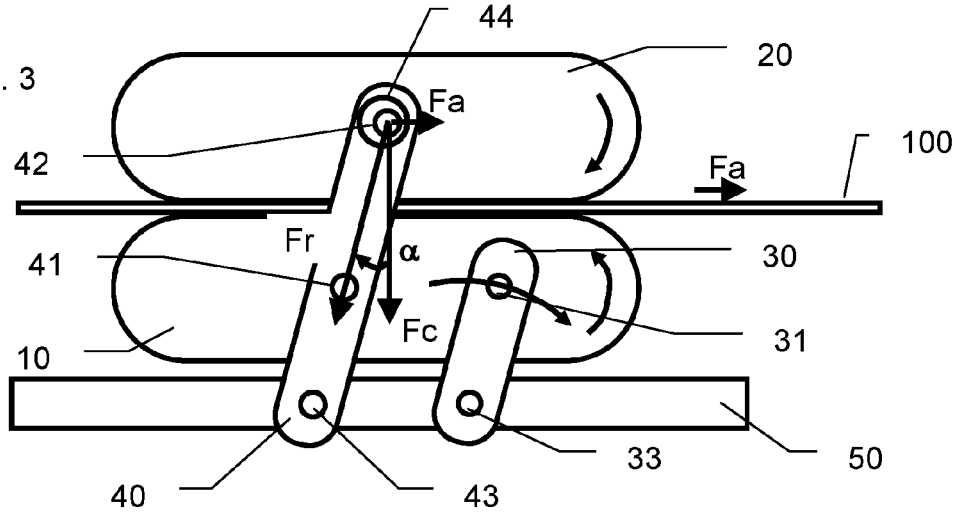
FIG. 3 represents a third embodiment of the invention.

FIG. 3 represents a third embodiment of the invention. The reference driving caterpillar 10 and the moveable driving caterpillar 20 are both moveable relatively to the supporting frame 50 as the first pivoting lever 30 and the second pivoting lever 40 are both attached to the supporting frame 50 through rotation axes 33 and 43, respectively.The difference with respect to the second embodiment is that the moveable driving caterpillar is only attached to the pivoting lever 40, increasing its degrees of freedom compared to the first and second embodiments, as the moveable driving caterpillar can freely rotate around the rotation axis 42. Advantageously, the first rotation axis and/or the second rotation axis is attached to the at least one pivoting lever through an eccentric case. For example, as shown in FIG. 3, the second rotation axis 42 is attached to the second pivoting lever 40 through an eccentric case 44. Such eccentric cases provide an easy and fast set up of the distance between the first axis 42 and the second axis 41. Fine tuning is also possible with this embodiment.

The second and third embodiments, with the first and second pivoting levers 30 and 40 respectively attached to the supporting frame 50 allow a vertical set up of the two driving caterpillars 10 and 20.

Figure 4A:
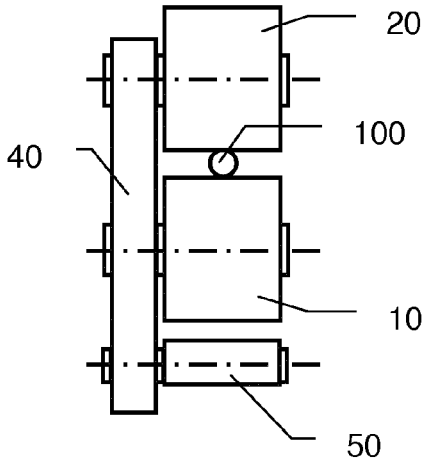
FIGS. 4*a* and 4*b* represent two alternatives of the second embodiment.

FIG. 4*a* is a side view of a first alternative of the second embodiment, showing that there are pivoting levers 40 arranged only at one side of the driving caterpillars 10 and 20. This alternative allows a swift and easy engagement or disengagement of the elongated element 100 between the two driving caterpillars 10 and 20, as one side is left free for access.

Figure 4B:
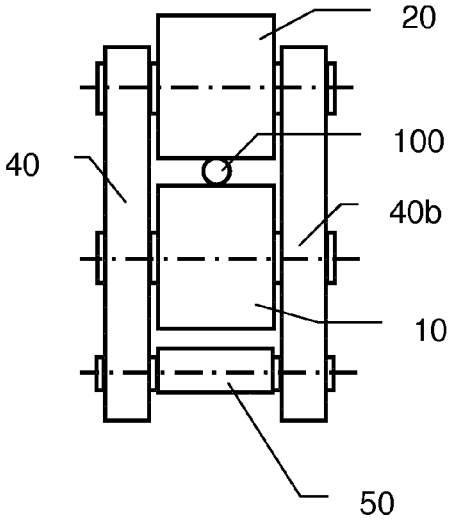

FIG. 4*b* is a side view of a second alternative of the second embodiment, showing that pivoting levers 40 and 40*b* are arranged on both sides of the driving caterpillars 10 and 20. This reduces the stress in the rotation axes, but the engagement or disengagement of the elongated element 100 between the driving caterpillars 10 and 20 may only be done through the free end of the elongated element 100.

The alternatives shown on FIGS. 4*a* and 4*b* are of course not limited to the second embodiment of the invention, and may be used to any embodiment of the invention.

Another embodiment of the invention may consist in coupling any one of the pivoting levers with command means (a pneumatic or hydraulic cylinder, an elastic element, or an handle for example) to assist the movement of the pivoting levers and thus driving caterpillars to engage or disengage the elongated element 100, and/or to apply an additional clamping force during the driving of the elongated element.

It should be noted that all the embodiments of the present invention allow reversing the operating conditions, to push-pull the elongated element in two opposite directions. This set up is easily achieved by pivoting counterclockwise the represented pivoting levers 30 and 40 by an angle double that of the represented angle $\alpha$. The reference and moveable driving caterpillars 10, 20 then have to be powered in the opposite angular rotation, to apply an axial force Fa' opposite to the represented axial force Fa, thus creating a clamping force dependent on the predetermined angle $\alpha$. The need to remove the elongated element from the linear driving device and turning the linear driving device by 180° is avoided with such linear driving device having pivoting levers connecting the caterpillars. A linear and continuous pushing-pulling operation is possible with such linear driving device, and set up of the length between the rotation axes of the pivoting levers allows to adapt the clamping force.

It is understood that obvious improvements and/or modifications for one skilled in the art may be implemented, being under the scope of the invention as it is defined by the appended claims. In particular, it is made reference to caterpillars as driving means, but it may contemplated to use drums or wheels to apply the axial force to the elongated element. It is also said that the clamping force depends on the predetermined angle $\alpha$, but it also depends on the friction ratio between the elongated element and the powered driving element.

The invention claimed is:

1. A linear driving device comprising:

a reference driving element and a moveable driving element, wherein the linear driving device is arranged to drive an elongated element located between the reference driving element and the moveable driving element, at least one of the reference driving element and the moveable driving element being powered to apply an axial force to the elongated element to drive it, the moveable driving element being moveable relative to the reference driving element so that the axial force, combined with a friction force between the elongated element and the moveable driving element presses the moveable driving element towards the reference driving element to create a clamping force on the elongated element, at least one pivoting lever attached to the reference driving element by a first rotation axis and to the moveable driving element by a second rotation axis, an eccentric case coupling at least one of the first rotation axis and the second rotation axis to the at least one pivoting lever, wherein when the elongated element is driven, the at least one pivoting lever is arranged so that the magnitude of the clamping force depends on a predetermined angle defined between a perpendicular direction to the axial force and a reaction force between the reference driving element and the moveable driving element and passing through the first and second rotation axes, and wherein the eccentric case is configured to adjust a distance between the first rotation axis and the second rotation axis, thereby adjusting the predetermined angle and the magnitude of the clamping force.

2. The linear driving device according to claim 1, wherein:

the second rotation axis is moveable along a circular trajectory in a trajectory plane, and when the elongated element is driven, the predetermined angle is defined within the trajectory plane, between a line passing through the first and second rotation axes and a direction perpendicular to the axial force.

3. The linear driving device according to claim 1, wherein the moveable driving element comprises a caterpillar powered to apply the axial force to the elongated element.

4. The linear driving device according to claim 1, wherein the reference driving element comprises a caterpillar powered to apply an additional axial force to the elongated element.

5. The linear driving device according to claim 1, wherein the moveable driving element, the reference driving element, and the at least one pivoting lever arranged in a first geometrical configuration apply a first axial force in a first direction of the elongated element, and wherein the moveable driving element, the reference driving element, and the at least one pivoting lever arranged in a second geometrical configuration, apply a second axial force in a second direction of the elongated element, opposite to the first direction of the elongated element.

6. The linear driving device according to claim 5, wherein the predetermined angle from the perpendicular direction to the reaction force in the first geometrical configuration has a first absolute value and is oriented in a first angular direction, and wherein the predetermined angle from the perpendicular direction to the reaction force in the second geometrical configuration has the same first absolute value but is oriented in a second angular direction opposite to the first angular direction.

7. The linear driving device according to claim 1, further comprising a supporting frame, wherein the at least one pivoting lever is connected to the supporting frame by a third rotation axis.

8. The linear driving device according to claim 1, further comprising a second pivoting lever attached to the reference driving element by a fourth rotation axis and to the moveable driving element by a fifth rotation axis, and arranged so that a line passing through the first and second axes is parallel to a line passing through the fourth and fifth rotation axes.

9. A linear driving device comprising:

a reference driving element and a moveable driving element arranged to drive an elongated element located between the reference driving element and the moveable driving element;

at least one of the reference driving element and the moveable driving element being powered to apply an axial force to the elongated element to drive it;

the moveable driving element being moveable relative to the reference driving element so that the axial force, combined with a friction force between the elongated element and the moveable driving element, presses the moveable driving element towards the reference driving element to create a clamping force on the elongated element;

at least one pivoting lever coupled to the reference driving element through a first pin to define a first rotation axis and to the moveable driving element through a second pin to define a second rotation axis;

an eccentric case coupling at least one of the first pin and the second pin and the at least one pivoting lever;

wherein the at least one pivoting lever is arranged so that the magnitude of the clamping force depends on a predetermined angle defined between a perpendicular direction to the axial force and a reaction force between the reference driving element and the moveable driving element and passing through the first and second rotation axes, and wherein a distance between the first rotation axis and the second rotation axis is configured to be adjusted through the eccentric case, thereby adjusting the predetermined angle and the magnitude of the clamping force.

* * * * *